US010867474B2

(12) United States Patent
Yi

(10) Patent No.: US 10,867,474 B2
(45) **Date of Patent: *Dec. 15, 2020**

(54) ONLINE GAMING PLATFORM INTEGRATED WITH MULTIPLE VIRTUAL CURRENCIES

(71) Applicant: Min Yi, Manassas, VA (US)

(72) Inventor: Min Yi, Manassas, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/228,309

(22) Filed: Dec. 20, 2018

(65) Prior Publication Data

US 2019/0122495 A1 Apr. 25, 2019

Related U.S. Application Data

(63) Continuation-in-part of application No. 16/167,914, filed on Jan. 21, 2019, now Pat. No. 10,586,427.

(51) Int. Cl.
*G07F 17/32* (2006.01)

(52) U.S. Cl.
CPC ..... *G07F 17/3244* (2013.01); *G07F 17/3209* (2013.01); *G07F 17/3225* (2013.01)

(58) Field of Classification Search
CPC ..... G07F 17/3244; G07F 17/3209; G07F 17/3225
USPC ..... 463/25
See application file for complete search history.

(56) References Cited

U.S. PATENT DOCUMENTS 8,449,378 B2 * 5/2013 Michaelson ..... G06Q 20/0655 463/16
8,523,657 B2 * 9/2013 Michaelson ..... G07F 17/3225 463/16
2014/0295956 A1 * 10/2014 Katz ..... G07F 17/3241 463/29
2014/0370969 A1 * 12/2014 LeMay ..... G07F 17/3248 463/25
2016/0027260 A1 * 1/2016 Pierce ..... G07F 17/3237 463/7
2018/0025442 A1 * 1/2018 Isaacson ..... H04L 63/0861 705/26.62

* cited by examiner

*Primary Examiner* — Allen Chan
(74) *Attorney, Agent, or Firm* — Barry Choobin; Patent 360

(57) ABSTRACT

The present invention discloses disclose an online gaming platform with integrated crypto currency exchange or transactions. The online crypto currency exchange is integrated with online gaming platform such as casino games, poker games and the like, such that the games are played with any crypto currency seamlessly. The players play the games directly from the crypto exchange account.

8 Claims, 1 Drawing Sheet

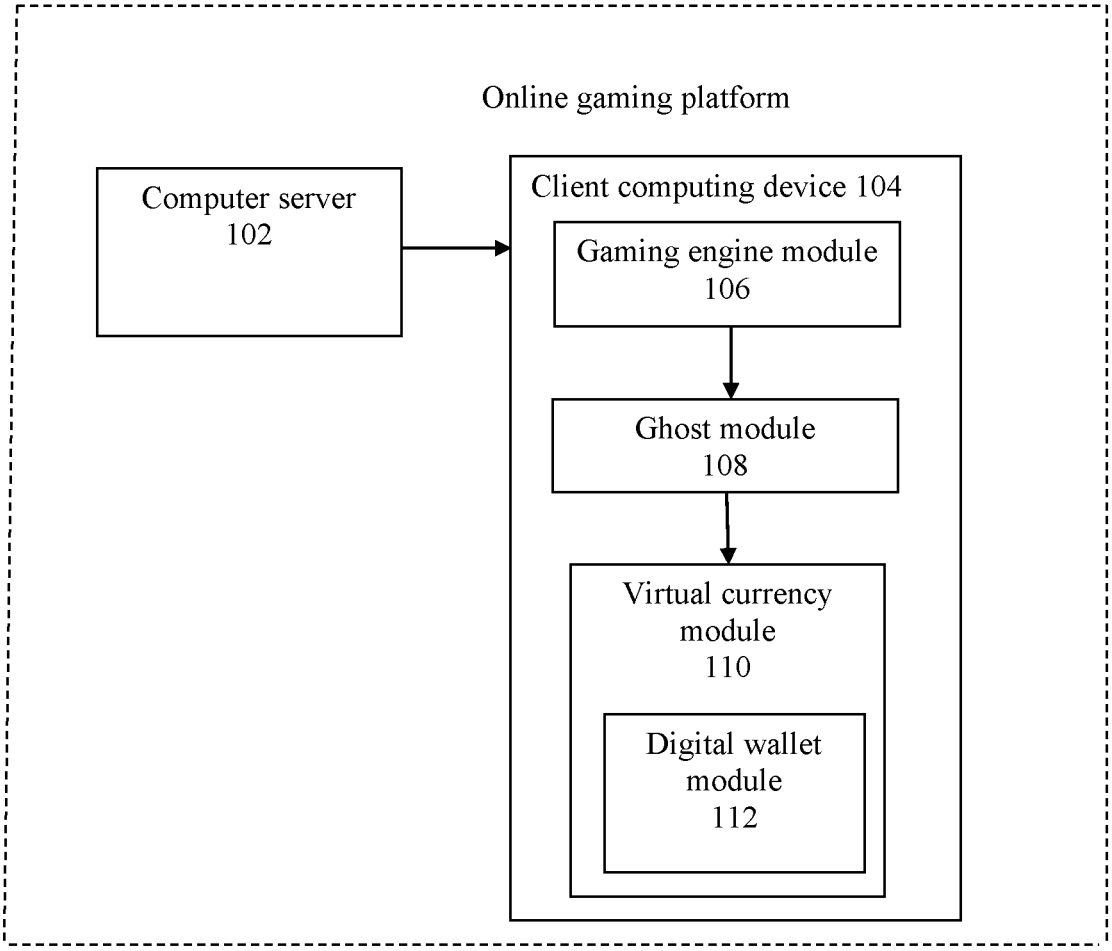
100

ONLINE GAMING PLATFORM INTEGRATED WITH MULTIPLE VIRTUAL CURRENCIES

CROSS REFERENCE TO RELATED APPLICATION

This application is a continuation-in-part of U.S. patent application Ser. No. 16/167,914 filed Oct. 23, 2018 which is hereby incorporated by reference in its entirety.

BACKGROUND

Technical Field

The embodiments herein generally relate to the field of online gaming and more particularly, online gaming platform integrating various types of virtual currencies.

Description of the Related Art

In recent years, digital currencies have become more popular and have become widely accepted as an alternative to traditional government issued (fiat) currency. Many digital currencies, and in particular Bitcoin, have made their way into a vast range of business transaction. Instead of using fiat currency to purchase items, holders of digital currencies can use them to purchase products and services.

Given that digital currencies have made their way into mainstream commerce, there is now a need to allow people to use digital currencies such as Bitcoins as an alternative to fiat currencies when playing online games.

The abovementioned shortcomings, disadvantages and problems are addressed herein and which will be understood by reading and studying the following specification.

OBJECT OF THE EMBODIMENTS HEREIN

The primary object of the embodiments herein is to provide an online gaming platform integrated with online crypto currency exchange so as to facilitate players to play games with any crypto currency seamlessly.

Another object of the embodiments herein is to integrate all types of crypto currency to online gaming seamlessly.

Yet another object of the embodiments herein is to provide an online gaming platform where the players can play the games directly from the crypto exchange account.

These and other objects and advantages of the embodiments herein will become readily apparent from the following summary and the detailed description taken in conjunction with the accompanying drawings.

SUMMARY

The following details present a simplified summary of the embodiments herein to provide a basic understanding of the several aspects of the embodiments herein. This summary is not an extensive overview of the embodiments herein. It is not intended to identify key/critical elements of the embodiments herein or to delineate the scope of the embodiments herein. Its sole purpose is to present the concepts of the embodiments herein in a simplified form as a prelude to the more detailed description that is presented later.

The present invention discloses an online gaming platform with integrated crypto currency exchange or transactions . . . . The online crypto currency exchange is integrated with online gaming platform such as casino games, poker games and the like, such that the games are played with any crypto currency seamlessly. The players play the games directly from the crypto exchange account.

The present invention discloses that the online gaming application and sites have coin tables, such as Bitcoin™ (BTC), Litecoin (LTC), XRP (Ripple) or any other crypto currency type. The players play game in a table comprising uniform crypto currency coins.

According to one embodiment, the players are playing in Bitcoin currency. The estimation of the Bitcoin currency is shown next to the total of Bitcoin. The estimation is shown in different types of currencies such as Dollar, Euros, Yen, Yuan or any other currency type chosen by the players. The players are betting in Bitcoin but the estimation value of the Bitcoin is shown for friendly use. The game pot is in Bitcoin and is illustrated in estimated choice of currency value. The rake in the game is taken with Bitcoin value. The dollar currency value is reset before start of the game as per the market value. The dollar value remains same until the game is finished.

According to another embodiment, the different types of crypto currencies are brought in to the same table. In such a scenario First player has Bitcoins, Second player has 10-ETH, Third player has 3000-XRP, and Fourth player has 40 LTC and Player 5 250 EOS. The players are playing in their own crypto currency and have estimation illustrated in different types of currencies such as USD, Euros, Yen, Yuan or any other type of currency chosen by the players. The players bet in their own coin but the estimation values are illustrated next to the crypto currencies. The players are in the game with different types of coins having different estimation values. When the players are betting, they bet in dollar values of their coins. The game pot is holding estimation value in dollar.

The game program calculates the values of the player's coins into estimated dollar value during the game play. When the pot is awarded to the winner player, the game pot estimated dollar is converted back to the players coins. The rake is taken with the winners coins. The dollar currency value is reset every start of the game to the market and remains at the same value until the game is finished.

In yet another embodiment disclosed herein, the different types of crypto currencies are brought in at a single table. In such a scenario first player has Bitcoins, second player has ETH, third player has XRP (Ripple), and fourth player has LTC and fifth player has EOS. The players are playing in their respective crypto currencies directly from their crypto wallet. The players bet in their own coins. When the game pot is awarded to the winning player, the winner is paid with the respective currencies of all the players involved in the game and also the rake is paid with the currency of the all the players involved in the game. Thus, each player seated with currency of his choice is able to play poker at the same table with other players having currency of their choice which may be different. This facilitates playing directly from the player's crypto wallet while seated with other players playing with currency of their choice.

Accordingly an online gaming platform is provided that comprises at least one computer server communicable with at least one client computing device over a network, the client computing device having a processor and a memory, a gaming engine module stored on the memory and executable by the processor, the gaming engine module having program code that when executed, generates an interactive game play instance playable on the client computing device, a virtual currency module stored on the memory and executable by the processor, the virtual currency module having program code that when executed, issues and manages a plurality of virtual currency accounts and a ghost module for operably coupling the virtual currency module with at least one crypto currency platform.

In one exemplary embodiment, the crypto currency is in one of a Bitcoin, Litecoin and Ripple.

The gaming engine module is configured to process one or more inputs generated by each player and accordingly determines number of credits to be made available for the respective player. The gaming engine module is thus configured for generating a record of the credits made available for each player.

Further, the virtual currency module further comprises a digital wallet module and is configured to generate and store record of each transaction. In one embodiment, the transaction may involve real/fiat currency.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which:

FIG. 1 illustrates a block diagram depicting the online gaming platform, according to an embodiment of the invention disclosed herein.

Although the specific features of the embodiments herein are shown in some drawings and not in others. This is done for convenience only as each feature may be combined with any or all of the other features in accordance with the embodiment herein.

DETAILED DESCRIPTION OF THE EMBODIMENTS HEREIN

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

In the following detailed description, a reference is made to the accompanying drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein disclose an online gaming platform with integrated crypto currency (also referred to herein as virtual currency) exchange or transactions. The online crypto currency exchange is integrated with online gaming platform such as casino games, poker games and the like, such that the games are played with any crypto currency seamlessly. The players play the games directly from the crypto exchange account.

Accordingly, in one embodiment as shown in FIG. 1, an online gaming platform 100 is disclosed. The online gaming platform 100 comprises at least one computer server 102 communicable with at least one client computing device 104 over a network, the client computing device 104 having a processor and a memory, a gaming engine module 106 stored on the memory and executable by the processor, the gaming engine module 106 having program code that when executed, generates an interactive game play instance playable on the client computing device 104 and a virtual currency module 110 stored on the memory and executable by the processor, the virtual currency module 110 having program code that when executed, issues and manages virtual currency accounts in addition to performing currency exchange between fiat currency and virtual currency.

The computer server 102 is configured for storing, processing and providing information to a player. For this purpose, each of the computer server 102 and the client computing device 104 may include memory, a processor and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In one embodiment, the server may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, online gaming application.

Further, the computer server 102 may include a database (e.g., in memory and/or through a wired and/or a wireless connection) for storing data received from the multiple client computing device 104*s* coupled to the computer server 102 via the communication network. Additionally, the computer server 102 may store information related to the player, location parameters of the land selected to be cultivated by the player and spatial parameters of the selected land obtained using the geographical information system. The computer server 102 may further comprise a User Interface (UI) directly coupled to the database so as to facilitate display of data stored in the database.

Any database discussed herein may include relational, hierarchical, graphical, or object-oriented structure and/or any other database configurations. Common database products that may be used to implement the databases include DB2 by IBM (White Plains, N.Y.), various database products available from Oracle Corporation (Redwood Shores, Calif.), Microsoft Access or Microsoft SQL Server by Microsoft Corporation (Redmond, Wash.), MySQL, or any other suitable database product. Moreover, the databases may be organized in any suitable manner, for example, as data tables or lookup tables. Each record may be a single file, a series of files, a linked series of data fields or any other data structure. Association of certain data may be accomplished through any desired data association technique such as those known or practiced in the art.

The virtual currency module 110 further comprises program code that when executed, issues the credits, tokens, and gifts as virtual currency bundles.

In one embodiment, the virtual currency may be purchased using real currency, credit virtual currency, special virtual currency, ordinary virtual currency, and/or the like. For example, virtual currency may be transferred by winning the virtual currency, receiving the virtual currency as a gift, and/or the like.

The online gaming platform 1000 further comprises a ghost module 108 for operably coupling the online gaming platform 100 with other crypto exchange platforms sand also third-party crypto exchange platforms. The ghost module 108 couples the gaming module with the virtual currency module seamlessly so as to enable the player to play the game straight from his/her exchange or wallet.

Thus, the ghost module 108 seamlessly integrates the cryptocurrency coins generated under different types of blockchain technology in the cryptocurrency market for example ERC20.

In one embodiment, the player can play the game and use the exchange straight from their account, thereby eliminating the need for the online gaming platform to hold any of the player's fund.

In another embodiment, the digital wallet module 112 is a part of the central server. Accordingly, each player is required to deposit money into the digital wallet maintained in the online gaming/exchange platform. Thus, the online gaming platform is holding the player's funds during the play and trades. The player is partially empowered to operate their wallet.

In yet another embodiment, the digital wallet module 112 is embedded in the web browser application on the client computing device. In this scenario, the player's fund is not stored in the central server but the funds are stored in the digital wallet associated with the player. Further, the player may be provided with private keys so as to fully empower the player to operate the wallet.

The virtual currency module 112 is configured to generate and store record of each transaction. In one embodiment, transaction details may be included in a transaction details data structure included as part of the request. For example, the transaction details data structure may be passed in as an argument to a function written in the PHP programming language (e.g., the transaction details data structure may include a variety of fields such as the unique ID (UID) for a player involved in the transaction, type of virtual currency to be credited, amount of virtual currency to be credited, and/or the like).

The present invention discloses that the online gaming application and sites have coin tables, such as Bitcoin™ (BTC), Litecoin (LTC), XRP (Ripple) or any other crypto currency type. The players play game in a table comprising uniform crypto currency coins.

In one embodiment, the players are playing in Bitcoin currency. The estimation of the Bitcoin currency is shown next to the total of Bitcoin. The estimation is shown in different types of real currencies such as Dollar, Euros, Yen, Yuan or any other currency type chosen by the players. The players are betting in Bitcoin but the estimation value of the Bitcoin is shown for friendly use. Game pot is the value of bid money in the game. The game pot is in Bitcoin and is illustrated in estimated choice of currency value. The rake in the game is taken with Bitcoin value. The dollar currency value is reset before start of the game as per the market value. The dollar value remains same until the game is finished.

The player is allowed to convert the virtual currency into the requested real currency or vice versa. For this purpose, a conversion rate between the real currency and the requested virtual currency may be determined. For example, the conversion rate may be static (e.g., it may be retrieved from a database). In another example, the conversion rate may be calculated dynamically (e.g., based on information associated at the time of beginning the game).

Accordingly, the present invention enables embedding the currency conversion to the online games from the live exchange market.

In another embodiment, the different types of crypto currencies are brought in at a single table. In such a scenario first player has Bitcoins, second player has 10-ETH, third player has 3000-XRP (Ripple), and fourth player has 40 LTC and Player 5 250 EOS. The players are playing in their own crypto currency and have estimation illustrated in different types of currencies such as USD, Euros, Yen, Yuan or any other type of currency chosen by the players. The players bet in their own coin but the estimation values are illustrated next to the crypto currencies. The players are in the game with different types of coins having different estimation values. When the players are betting, they bet in dollar values of their coins. The game pot is holding estimation value in dollar.

The game program calculates the values of the player's coins into estimated dollar value during the game play. When the game pot is awarded to the winner player, the game pot estimated dollar is converted back to the players coins. The rake is taken with the winners coins. The dollar currency value is reset every start of the game to the market and remains at the same value until the game is finished.

In yet another embodiment disclosed herein, the different types of crypto currencies are brought in at a single table. In such a scenario first player has Bitcoins, second player has ETH, third player has XRP (Ripple), and fourth player has LTC and fifth player has EOS. The players are playing in their respective crypto currencies directly from their crypto wallet. The players bet in their own coins. When the game pot is awarded to the winning player, the winner is paid with the respective currencies of all the players involved in the game and also the rake is paid with the currency of the all the players involved in the game. Thus, each player seated with currency of his choice is able to play poker at the same table with other players having currency of their choice which may be different. This facilitates playing directly from the player's crypto wallet while seated with other players playing with currency of their choice.

In an exemplary embodiment, a first player owns a crypto wallet with bitcoin currency and plays with a second player seated on the same table, the second player opting to play with different currency such as XRP. In the scenario that the first player wins the game, the game pot is award with all the coins that were played with. Accordingly, the first player is paid with bitcoin currency along with the XRP of the second player. Further, the rake is paid with the currency of all the players involved that is with the bitcoin and XRP.

In an additional embodiment, the crypto currency may be replaced with the real/fiat currency thereby facilitating online gaming with real currency. In this embodiment, real currencies representing different countries can be brought under a single table along with one or more virtual currencies. Accordingly, players may use a virtual wallet with real money or a real wallet with real money along with a virtual wallet with virtual money and participate in the online game. The players bet in one of the real currency and the virtual currency. When the game pot is awarded to the winning player, the game pot is awarded in a combination of the real currency and the virtual currency. Likewise, the rake is taken in a combination of the real currency and the virtual currency.

The online gaming platform disclosed herein integrates the crypto exchange platform with online poker game, for example, which distinguished the present invention from prior art online games with crypto currency.

The integration of the crypto exchange platform with the online gaming platform as disclosed herein eliminates the need for the player to buy the host (game industry) coin to play and enables the player to play the game with the currency of his choice and earn that same currency coin.

In one embodiment, the online gaming platform may be configured as an application in the client computing device 104. Applications, as used herein, include any set of computing instructions. Applications instruct an electronic device to perform specified functions. Applications typically contain logic and methods for accessing, manipulating, and storing data. Examples of applications include word processors, web browsers, email clients, games (e.g., chess games, etc), and media players. Applications may contain instructions on displaying and formatting data. For example, an application may instruct an electronic device to access certain data and display it in a specified format and/or at a specified time.

Applications may be transported via any method suitable for such purpose. For example, the applications may be downloaded to the client computing device 104 via a Web browser or may be transported to the client computing device 104 using a "push" type operation via a network protocol over a cable or wireless infrastructure. Possible means for pushing an application or application reference include, but are not limited to, email, embedding in a Web page, part of an RSS feed, a WAP™ Push or a Bluetooth™ Transmission. The system for deploying applications to the client computing device 104*s* may optionally include a runtime environment for the application. A runtime environment is software that allows a client computing device 104 to execute application code.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

The online gaming platform disclosed herein can be programmed into a computer readable media. Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

While various embodiments and discussions of the invention have been directed to using multiple types of virtual currency in online games, however, it is to be understood that the embodiments described herein may be readily configured and/or customized for a wide variety of other offline gaming and non-gaming applications and/or implementations.

The advantages of the embodiments disclosed herein comprise providing integration of online crypto currency exchange with online gaming such as casino games, poker games and any such game so as to facilitate playing these games with any crypto currency seamlessly thereby integrating all types of crypto currency to online gaming. Further players can play the games directly from the crypto exchange account.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications.

However, all such modifications are deemed to be within the scope of the appended claims.

It is also to be understood that the following claims are intended to cover all of the generic and specific features of the embodiments described herein and all the statements of the scope of the embodiments which as a matter of language might be said to fall there between.

What is claimed is:

1. An online gaming platform comprising:

at least one computer server communicable with at least one client computing device over a network, the client computing device having a processor and a memory;

a gaming engine module stored on the memory and executable by the processor, the gaming engine module having program code that when executed, generates an interactive gameplay instance playable on the client computing device;

a virtual currency module stored on the memory and executable by the processor, the virtual currency module having program code that when executed, issues and manages a plurality of virtual currency accounts; and a ghost module for operably coupling the virtual currency module with at least one crypto currency platform; and wherein said online gaming platform is integrated with an exchange module to enable multiple virtual currencies to be used simultaneously, wherein said virtual currencies are transferred between accounts by utilizing funds held on-platform to perform a round of a gameplay, and crediting said funds back to an "off-platform" at the conclusion of the round of the gameplay.

2. The online gaming platform of claim 1, wherein the crypto currency is in one of a Bitcoin, Litecoin and Ripple.

3. The online gaming platform of claim 1, wherein the virtual currency module further comprises a digital wallet module.

4. The online gaming platform of claim 1, wherein, the gaming engine module is configured to process one or more inputs generated by each player and accordingly determines number of credits to be made available for the respective player.

5. The online gaming platform of claim 4, wherein, the gaming engine module is configured for generating a record of the credits made available for each player.

6. The online gaming platform of claim 1, wherein the virtual currency module is configured to generate and store record of each transaction.

7. The online gaming platform of claim 6, wherein the virtual currency module is configured to generate and store record of each transaction wherein the transaction involves at least one fiat currency.

8. An online gaming platform comprising:

at least one computer server communicable with at least one client computing device over a network, the client computing device having a processor and a memory;

a gaming engine module stored on the memory and executable by the processor, the gaming engine module having program code that when executed, generates an interactive gameplay instance playable on the client computing device;

a virtual currency module stored on the memory and executable by the processor, the virtual currency module having program code that when executed, issues and manages virtual currency accounts in addition to performing currency exchange between real currency and virtual currency, displays in near real time, on the client computing device, balance and transactions of the virtual currency account in the real currency value, issues private keys for operating the virtual currency accounts, and wherein the virtual currency can be received in the virtual currency account by winning in a game or as a gift; and a ghost module for operably coupling the virtual currency module with at least one crypto currency platform, wherein said online gaming platform is integrated with an exchange module to enable multiple virtual currencies to be used simultaneously, wherein said virtual currencies are transferred between accounts by utilizing funds held on-platform to perform a round of a gameplay, and crediting said funds back to an "off-platform" at the conclusion of the round of the gameplay.

* * * * *